US008960279B2

(12) United States Patent
Lembcke et al.

(10) Patent No.: US 8,960,279 B2
(45) **Date of Patent: *Feb. 24, 2015**

(54) EROSIONAL PROTECTION OF FIBER OPTIC CABLE

(71) Applicant: Weatherford/Lamb, Inc., Houston, TX (US)

(72) Inventors: Jeffrey J. Lembcke, Cypress, TX (US); Francis Bostick, III, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/922,771

(22) Filed: Jun. 20, 2013

(65) Prior Publication Data

US 2013/0277041 A1 Oct. 24, 2013

Related U.S. Application Data

(63) Continuation of application No. 11/680,717, filed on Mar. 1, 2007, now Pat. No. 8,496,053.

(51) Int. Cl.
*E21B 47/01* (2012.01)

(52) U.S. Cl.
CPC ..... *E21B 47/011* (2013.01)
USPC ..... 166/242.2; 166/66; 385/12; 385/100

(58) Field of Classification Search
USPC ..... 166/250.01, 66, 227, 242.1, 242.2; 385/12, 100, 101, 107, 109, 113, 103, 385/11; 367/69, 81, 25
See application file for complete search history.

(56) References Cited

U.S. PATENT DOCUMENTS

| | | | | |
|---|---|---|---|---|
| 4,522,464 | A | 6/1985 | Thompson et al. | |
| 4,718,747 | A * | 1/1988 | Bianchi et al. | 385/128 |
| 4,890,898 | A * | 1/1990 | Bentley et al. | 385/101 |
| 4,978,346 | A | 12/1990 | Bentley | |
| 5,192,948 | A | 3/1993 | Troyer et al. | |
| 5,339,895 | A | 8/1994 | Arterbury et al. | |
| 5,901,789 | A | 5/1999 | Donnelly et al. | |
| 6,060,662 | A * | 5/2000 | Rafie et al. | 174/106 R |
| 6,571,046 | B1 * | 5/2003 | Hickey et al. | 385/134 |
| 6,690,866 | B2 * | 2/2004 | Bonja et al. | 385/109 |

(Continued)

FOREIGN PATENT DOCUMENTS

| | | |
|---|---|---|
| GB | 2063502 | 6/1981 |
| GB | 2333610 | 7/1999 |

(Continued)

OTHER PUBLICATIONS

Search Report dated May 14, 2008, issued in British Patent Application No. GB0803735.0.

(Continued)

*Primary Examiner* — Robert E Fuller
(74) *Attorney, Agent, or Firm* — Patterson & Sheridan, LLP

(57) ABSTRACT

A method and apparatus for preventing erosion of a cable for use in a wellbore is described herein. The cable has one or more optical fibers adapted to monitor and/or control a condition in the wellbore. The cable includes a layer of elastomeric material at least partially located on an outer surface of the cable. The elastomeric material is adapted to absorb energy due to the impact of particles in production fluid or wellbore fluid against the cable.

18 Claims, 3 Drawing Sheets

(56) References Cited

U.S. PATENT DOCUMENTS

| | | | | |
|---|---|---|---|---|
| 6,711,329 | B2 * | 3/2004 | Zelesnik | 385/100 |
| 6,727,828 | B1 | 4/2004 | Malone et al. | |
| 6,789,621 | B2 | 9/2004 | Wetzel et al. | |
| 7,024,081 | B2 | 4/2006 | Dowd et al. | |
| 7,196,838 | B2 * | 3/2007 | Adams et al. | 359/333 |
| 7,603,011 | B2 * | 10/2009 | Varkey et al. | 385/101 |
| 2001/0051030 | A1 * | 12/2001 | Hofner | 385/109 |
| 2002/0126969 | A1 | 9/2002 | Bonja et al. | |
| 2004/0020681 | A1 * | 2/2004 | Hjortstam et al. | 174/102 SC |
| 2004/0264831 | A1 * | 12/2004 | Leppert | 385/12 |
| 2006/0076476 | A1 | 4/2006 | Thingbo et al. | |
| 2007/0107928 | A1 * | 5/2007 | Varkey et al. | 174/102 R |
| 2007/0158095 | A1 * | 7/2007 | Sridhar et al. | 174/106 R |

FOREIGN PATENT DOCUMENTS

| | | |
|---|---|---|
| GB | 2360584 | 9/2001 |
| GB | 2386625 | 9/2003 |

OTHER PUBLICATIONS

Examination Report dated Feb. 25, 2011, issued by the UK Intellectual Property Office in Application No. GB0803735.0.

Examination Report dated Apr. 12, 2011, issued by the Canadian Intellectual Property Office in Application No. 2,623,623.

Examination Report dated Feb. 2, 2012, issued by the UK Intellectual Property Office in Application No. GB0803735.0.

* cited by examiner

EROSIONAL PROTECTION OF FIBER OPTIC CABLE

CROSS-REFERENCE TO RELATED APPLICATIONS

This application is a continuation of U.S. patent application Ser. No. 11/680,717, filed Mar. 1, 2007.

BACKGROUND OF THE INVENTION

1. Field of the Invention

Embodiments described herein generally relate to an apparatus and method of protecting one or more optical fibers. More particularly, the apparatus includes an optical fiber having a portion which is covered by an elastomeric material. More particularly still, the elastomeric material is configured to prevent erosion of the optical fibers in a wellbore.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the wellbore. A cementing operation is then conducted in order to fill the annular area with cement. The combination of cement and casing strengthens the wellbore and facilitates the isolation of certain areas of the formation behind the casing for the production of hydrocarbons.

The wellbore may be produced by perforating the casing of the wellbore proximate a production zone in the wellbore. Hydrocarbons migrate from the production zone, through the perforations, and into the cased wellbore. In some instances, a lower portion of a wellbore is left open, that is, it is not lined with casing. This is known as an open hole completion. In that instance, hydrocarbons in an adjacent formation migrate directly into the wellbore where they are subsequently raised to the surface, possibly through an artificial lift system.

During the production of the zone, sand and other aggregate and fine materials may be included in the hydrocarbon that enters the wellbore. These aggregate materials present various risks concerning the integrity of the wellbore. Sand production can result in premature failure of artificial lift and other downhole and surface equipment. Sand can build up in the casing and tubing to obstruct well flow. Particles can compact and erode surrounding formations to cause liner and casing failures. In addition, produced sand becomes difficult to handle and dispose of at the surface.

To control particle flow from production zones, sand screens are often employed downhole proximate the production zone. The sand screens filter sand and other unwanted particles from entering the production tubing. The sand screen is connected to production tubing at an upper end and the hydrocarbons travel to the surface of the well via the tubing.

In well completions, the operator oftentimes wishes to employ downhole tools or instruments in the wellbore. These include sliding sleeves, submersible electrical pumps, downhole chokes, and various sensing devices. These devices are controlled from the surface via hydraulic control lines, electrical control lines, mechanical control lines, fiber optics, and/or a combination thereof. For example, the operator may wish to place a series of pressure and/or temperature sensors every ten meters within a portion of the hole, connected by a fiber optic control line. This line would extend into that portion of the wellbore where a sand screen or other tool has been placed.

In order to protect the control lines or instrumentation lines, the lines are typically placed into small metal tubings which are affixed external to the tubular and the production tubing within the wellbore. The metal tubing is rapidly eroded when placed in a flow path containing sand or other aggregate materials. The erosion of the metal tubing causes the eventual failure of the control line or instrument line. The replacement of the control line is expensive and may delay other production or work on the drill rig.

There is a need for a control or instrument line for use in a wellbore having an abrasive resistant material on an outer surface. There is a further need for a line having an elastomeric material on its outer surface. There is a further need for the elastomeric material to be located only in a zone that is exposed to highly abrasive flow.

SUMMARY OF THE INVENTION

A wellbore system comprising a tubular located in a wellbore, a cable proximate to the tubular is described herein. The cable comprises one or more optical fibers, and a layer of elastomeric material on at least a portion of an outer surface of the one or more optical fibers configured to resist an abrasive condition in the wellbore.

A method of monitoring a condition in a wellbore is described herein. The method comprises placing a cable proximate a tubular in the wellbore, the cable having at least one optical fiber and a layer of elastomeric material on an outer surface of the cable. Locating the layer of elastomeric material proximate a sand screen coupled to the tubular. Flowing production fluid into the tubular through the sand screen and absorbing energy with the layer of elastomeric material, wherein the energy is created by a plurality of particles in the production fluid impacting the elastomeric material of the cable. Further, preventing the erosion of the cable by absorbing energy and interrogating a sensor in the optical fiber to determine a condition in the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
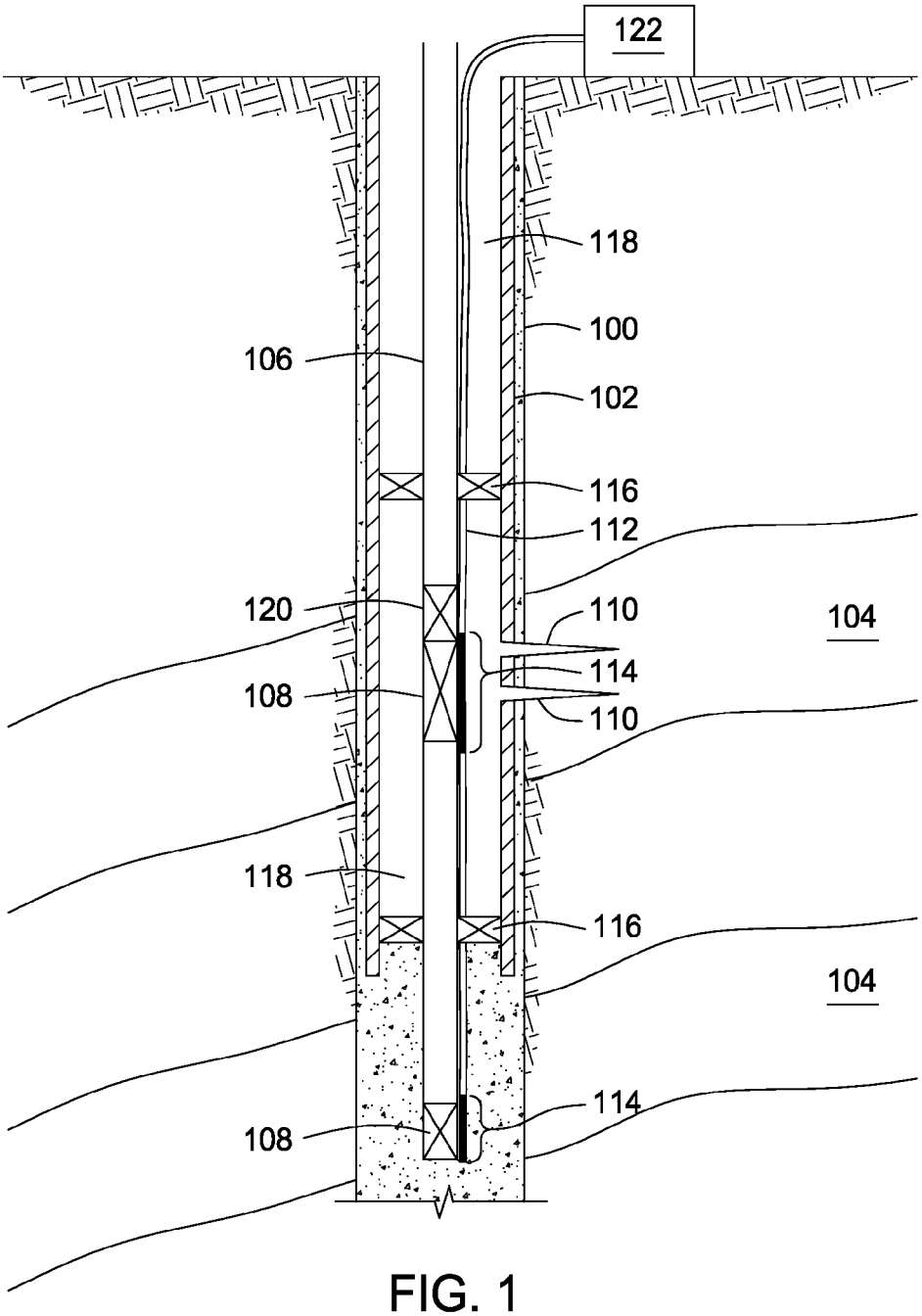
FIG. 1 is a schematic cross-sectional view of a wellbore according to one embodiment described herein.

Embodiments described herein generally relate to an apparatus and method of protecting a cable for use in a wellbore. FIG. 1 shows a wellbore 100 having a casing 102 cemented in place. The wellbore 100 intersects one or more production zones 104. The wellbore 100, as shown, contains a tubular 106 having one or more downhole tools 108 (shown schematically) integral with the tubular 106. One or more perforations 110 have been created in the casing 102 and the production zone 104. The perforations 110 create a flow path which allows fluid in the production zone 104 to flow into the casing 102. A cable 112 is coupled to the outer surface of the tubular 106 with clamps (not shown). It should be appreciated that any know method for coupling the cable 112 to the tubular 106 may be used. Further, it should be appreciated that the cable 112 need not be coupled to the tubular 106, that is the cable 112 may be a separate entity in the wellbore 100, or coupled to any other equipment in the wellbore 100. Although shown as the cable 112 being run on the outside of the tubular 106, it should be appreciated that the cable 112 may be run inside the tubular 106 or integral with the tubular 106. The cable 112 may be used as a control line for operating one or more downhole tools. In addition, or as an alternative, the cable 112 may be used as an instrument line in order to sense and relay downhole conditions to a controller or operator. Some production zones 104 may contain a large amount of sand or other material which flows with the production fluid. The sand creates a highly abrasive condition in the wellbore 100, causing the erosion of typical metal control lines. The cable 112 has one or more abrasive resistant portions 114. The one or more portions 114 comprise a layer of an elastomeric material on an outer surface of the cable 112, as will be described in more detail below. The one or more portions 114 are adapted to prevent the erosion of the cable in an area with highly abrasive fluid flow.

The tubular 106, as shown, is a production tubing; however, it should be appreciated that the tubular 106 may be any tubular for use in a wellbore, including but not limited to a drill string, a casing, a liner or coiled tubing. The production tubing is placed in the wellbore 100 and run to a location proximate the production zones 104. The production tubing is adapted to collect the production fluids from the wellbore and deliver them to the surface of the wellbore. The production tubing may include pumps, gas lift valves, screens, and valves in order to effectively produce the production zone 104.

The production tubing may be operatively coupled to one or more isolation members 116. The isolation members 116 are adapted to isolate an annulus 118 between the production tubing and the casing 102, and/or wellbore 100 from other portions of the wellbore 100. The isolation members 116, as shown, are adapted to isolate one of the production zones 104 thereby preventing production fluids from flowing beyond the isolation member and into another area of the wellbore. Further, the isolation members 116 prevent wellbore fluids from inadvertently entering the production zone 104 from the annulus. The isolation members 116 may be any downhole tool adapted to isolate the annulus including, but not limited to, a packer or a seal.

The downhole tools 108, as shown, are sand screens. The sand screens are adapted to allow production fluids to enter the tubular 106 while substantially preventing sand and other aggregate material from entering the tubular 106. The sand screen may be a traditional sand screen or an expandable sand screen depending on the requirements of the downhole operation. Examples of a sand screen are found in U.S. Pat. No. 5,901,789, and U.S. Pat. No. 5,339,895 both of which are herein incorporated by reference in its entirety. The sand screen may include a flow control valve 120. The flow control valve 120 may be controlled by the cable 112, in one embodiment. The flow control valve 120 allows the sand screen to prevent fluid flow into the tubular 106 until desired by an operator. The flow control valve 120 may be a sliding sleeve, a control valve, or any other flow control valve for use in a tubular. Although shown and described as being sand screens, it should be appreciated that the downhole tools 108 may be any downhole tools including, but not limited to, a pump, a valve, a packer, a sensor, or a motor. Further, it should be appreciated that there may not be a downhole tool 108.

The one or more cables 112 may be adapted to control the downhole tools 108 and/or the flow control valve 120 in one embodiment. Further, the one or more cables 112 may be adapted to monitor and relay downhole conditions to a controller 122 located on the surface. The one or more cables 112 include at least one optical fiber 200, shown in FIG. 2. The optical fiber 200 may be surrounded by one or more metal tubes 202, which is adapted to prevent impact damage and corrosion to the one or more optical fibers 200 during run in and downhole operations. The metal tubing 202 typically encompasses the circumference of the one or more optical fibers 200 along the entire length of the cable; however, it should be appreciated that the metal tubing 202 may extend less than the entire length of the cable 112.

Figure 2:
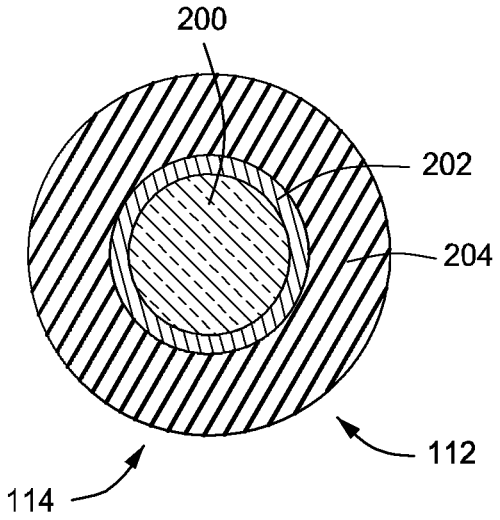
FIG. 2 is a cross-sectional view of a cable according to one embodiment described herein.

FIG. 2 is a cross sectional view of one of the cables 112 at one of the abrasive resistant portions 114, according to one embodiment. The abrasive resistant material is an elastomeric layer 204. The elastomeric layer 204, as shown, encapsulates the entire optical fiber 200. The one or more abrasive resistant portions 114 may be applied to the cable 112 only in regions where highly abrasive fluid flow is likely to occur in one embodiment. That is, the one or more portions 114 may be located only proximate the production zones 104 and/or only where the cable is proximate the sand screens. Although shown as proximate the sand screens, it should be appreciated that the one or more portions 114 may extend to other locations along the cable 112 or may encompass the entire length of the cable 112.

The elastomeric material of the elastomeric layer 204 is adapted to absorb impact from small sand or aggregate materials flowing in the production fluid. Thus, the elastomeric material tends to absorb the energy of the abrasive particles in the production fluids, thereby resisting erosion of the cable 112 proximate the production zone 104. The elastomeric material may be any polymeric materials which at ambient temperature can be stretched to at least twice their original length and return to their approximate original length when the force is removed. The elastomeric material is a non-thermoplastic elastomer, according to one embodiment. The elastomeric material may include, but is not limited to, natural rubber, polyisoprene, polybutadiene, acrylonitrile butadiene rubber, hydrogenated acrylonitrile butadiene rubber, chloroprene rubber, butyl rubber, polysulfide rubber, urethanes, styrene butadiene rubber, ethylene propylene rubber, ethylene propylene diene rubber, epichlorohydrin rubber, polyacrylic rubber, silicone rubber, fluorosilicone rubber, fluoroelastomers, perfluoroelastomers, tetrafluoro ethylene/propylene rubbers, chlorosulfonated polyethylene, ethylene-vinyl acetate. The elastomeric material may also retard heat transfer to the optical fiber 200 or metal tubing 202 due to the insulating properties of elastomers. While the elastomeric material may retard heat transfer to the optical fiber 200, the elastomeric material may be adapted to transfer pressure changes in the wellbore to the optical fiber 200. Thus, the optical fiber 200 having a fully encapsulated elastomeric layer 204 may measure pressure changes in the wellbore while being substantially unaffected by temperature changes in the wellbore 100.

When the cable 112 includes a temperature sensor such as a fiber optic temperature sensor, it may be necessary to provide the elastomeric layer 204 with a thermally conductive additive (not shown). The thermally conductive additive may be impregnated into the elastomeric material. The thermally conductive additive may be adapted to conduct heat from the wellbore fluids to the optical fiber 200 and/or the metal tubing 202. Therefore, the fiber optic temperature sensor may monitor the temperature in the wellbore 100 proximate the abrasive flow region without the risk of eroding the optical fiber 200 and/or the metal tubing 202. The thermally conductive additive, while allowing heat to be conducted, would not effect the energy absorbing quality of the elastomeric layer 204. In addition to conducting heat, the thermally conductive additive may be adapted to conduct or prevent electrical signals from passing through the elastomeric layer 204. In one embodiment, the thermally conductive additive is a boron nitride; however, it should be appreciated that the thermally conductive additive may include, but is not limited to, silver, gold, nickel, copper, metal oxides, boron nitride, alumina, magnesium oxides, zinc oxide, aluminum, aluminum oxide, aluminum nitride, silver-coated organic particles, silver plated nickel, silver plated copper, silver plated aluminum, silver plated glass, silver flakes, carbon black, graphite, boron-nitride coated particles and mixtures thereof, and carbon nano-tubes.

Figure 3:
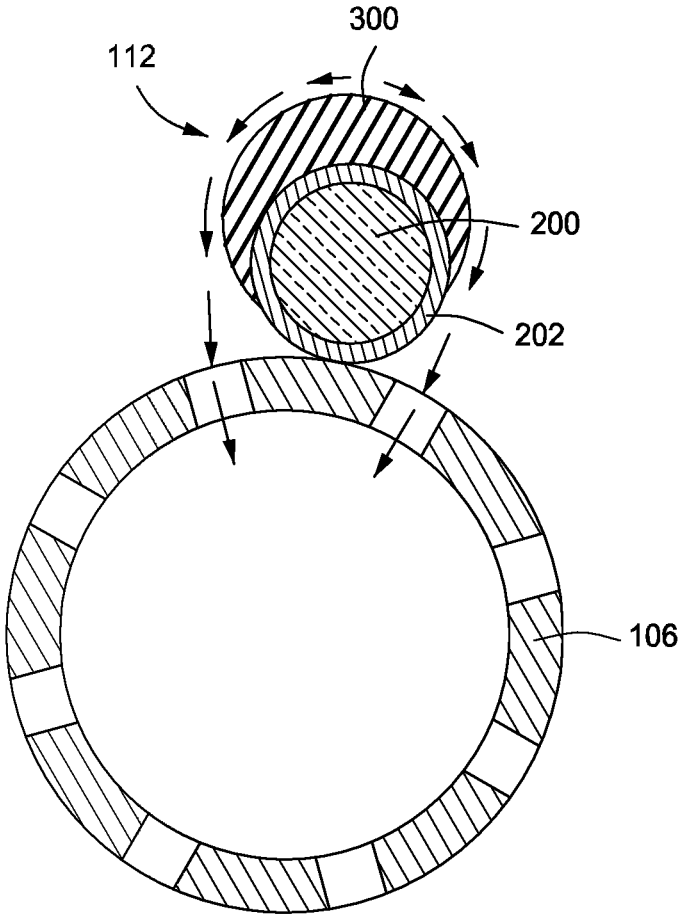
FIG. 3 is a cross-sectional view of a cable according to one embodiment described herein.

In an alternative embodiment, shown in FIG. 3, a partial elastomeric layer 300 is applied to the optical fiber 200 and/or the metal tubing 202. The partial elastomer layer comprises the same elastomeric material as described above. The partial elastomeric layer 300 may be applied to the cable 112 only in regions where highly abrasive fluid flow is likely to occur. In one embodiment, it should be appreciated that the partial elastomeric layer 300 may be applied anywhere on the cable, including the length of the entire cable. The partial elastomeric layer 300 may be adapted to cover the optical fiber 200 and/or the metal tubing 202 in the direction the abrasive flow occurs. That is, the partial elastomeric layer 300 may be applied only to the side of the optical fiber 200 that is likely to receive the abrasive flow as shown. That is the direction radially away from a central axis of the tubular 106. The partial elastomeric layer 300 allows the optical fiber 200 to be protected from erosion due to abrasive fluid flow, while allowing the optical fiber 200 to be influenced by temperature changes in the wellbore 100. This allows the cable 112 to be a temperature sensor in the abrasive zone without the need to impregnate the elastomeric material with the thermal conductive additive. Although, it should be appreciated that the additive may still be used. Further, the use of only a partial elastomeric layer uses less of the elastomeric material thereby reducing production costs. The partial elastomeric layer 300 may be preapplied to the cable 112, in one embodiment. Further, the partial elastomeric layer 300 may be applied to the cable 112 after or while the cable 112 is being secured to the tubular 106.

Figure 4:
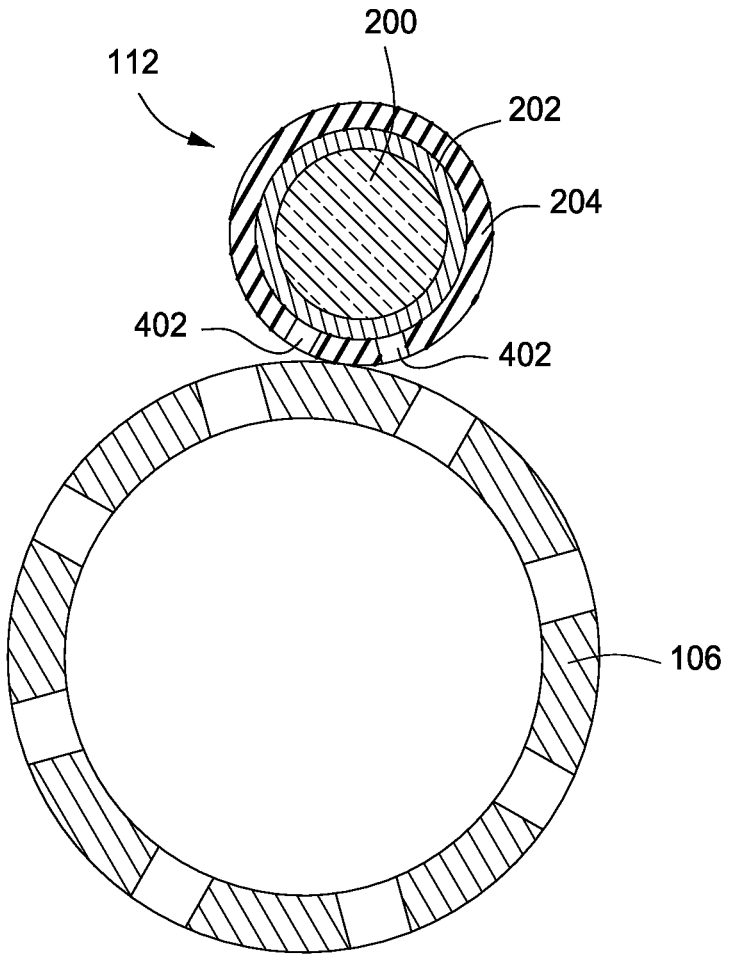
FIG. 4 is a cross-sectional view of a cable having holes in an elastomeric layer according to one embodiment described herein.

In another alternative, the elastomeric layer 204 may be applied to the optical fiber 200 and/or the metal tubing 202 with one or more holes or apertures 402 cut into the elastomeric layer 204 as illustrated in FIG. 4. The apertures 402 remove only the elastomeric material, thereby exposing the metal tubing 202 and/or the optical fiber 200 to the temperature in the wellbore 100. As with the partial elastomeric layer 300, the apertures 402 are adapted to face the tubular 106, thereby preventing the exposure of the metal tubing 202 and/or optical fiber 200 to the abrasive flow in the wellbore 100.

The cable 112 may include a protective layer, not shown, encapsulating the optical fiber 200 and/or metal tubing 202 in addition to, or as an alternative to, the elastomeric layer 204 and/or partial elastomeric layer 300. The protective layer may be a corrosion resistant material with a low hydrogen permeability, for example tin, gold, carbon, or other suitable material. The protective layer is adapted to protect the optical cable from impact loads and corrosion in the wellbore. The protective layer, however, is not effective in the highly abrasive environment near the sand screens. Thus, the protective layer may be applied to the cable throughout the length of the cable 112 with the exception of the areas proximate the sand screen or be covered by the elastomeric layer 204 and/or partial elastomeric layer 300 in the abrasive flow zones.

Further, the cable 112 may include a buffer material (not shown) located between the metal tubing 202 and the optical fiber 200. The buffer material may provide a mechanical link between the fiber 200 and the metal tubing 202 to prevent the optical fiber from sliding under its own weight within the cable 112.

The one or more optical fibers 200 may include one or more sensors (not shown) at various predetermined locations along the cable. The sensors may be any sensor used to monitor and/or control a condition in a wellbore 100. The sensors may include, but are not limited to, a Bragg grating based or interferometer based sensor, a distributed temperature sensing fiber, optical flowmeters, pressure sensors, temperature sensors or any combination thereof. In addition to one of the optical fibers 200 having multiple sensors, it is contemplated that the cable 112 includes multiple fibers 200, each having one or more sensors. In this embodiment, one optical fiber may monitor a certain region and/or condition in the wellbore 100 while another optical fiber monitors a different region and/or different condition in the wellbore 100. Thus, one optical fiber may have several sensors located proximate one production zone 104 adapted to measure the temperature and/or pressure proximate the production zone 104 while another optical fiber may be adapted to monitor the conditions proximate a second production zone 104. Further, a third optical fiber in the cable 112 may be adapted to control the operation of downhole tools 108 and valves 120 within the wellbore 100. In addition multiple cables 112 may be used, each containing one or more optical fibers 200 as described above.

The controller 122, shown schematically in FIG. 1, may include a processor, a wavelength interrogation or readout system, and an optional display. The processor is adapted to store and process information sent and received by the wavelength readout system. The wavelength readout system may be any system adapted to interrogate optical fibers and may include a reference system, which may include a fiber Bragg grating, an interference filter with fixed free spectral range (such as a Fabry-Perot etalon), or a gas absorption cell, or any combination of these elements. The wavelength readout system may include an optical source, an optical coupler, and a detection and processing unit. An example of a wavelength readout system is disclosed in U.S. Patent Publication No. US 2006/0076476, which is herein incorporated by reference in its entirety.

In operation, the wellbore 100 is formed in the ground and lined with a casing 102. The casing 102 is cemented into place thereby isolating the one or more production zones 104 from the inner bore of the casing 102. The tubular 106 may then be place inside the casing 102. As the tubular 106 is run into the casing 102 the cable 112 may be coupled to the tubular 106. It should be appreciated that the cable may be precoupled to the tubular 106 before run in. Further, it should be appreciated that the cable 112 may be independent of the tubular 106 and therefore not coupled to the tubular, or the tubular 106 may not be present and the cable 112 may be used in an open wellbore. The cable 112 is adapted in a manner that allows the abrasive resistant portions 114 to be proximate the production zones 104 once in the wellbore 100. The cable 112 may be a series of one or more cables 112 and each of the cables 112 may have one or more optical fibers 200 within the cable 112. Each of the optical fibers 200 may have one or more sensors located at predetermined intervals along the tubular 106.

The tubular 106 may include at least one downhole tool 108, which may be a sand screen and/or flow control valve. During the run in of the tubular 106 a light source may interrogate sensors in one or more of the optical fibers 200 in the one or more cables 112 in order to monitor down hole conditions such as pressure and temperature in the wellbore. The tubular 106 is lowered into the casing 102 until the downhole tool 108 is in a desired location, typically proximate the production zone 104. Further, multiple downhole tools 108 may be placed in the wellbore 100 proximate multiple production zones 104. The annulus 118 around the tubular 106 may then be sealed off using one or more isolation members 116. This allows each of the production zones 104 to be isolated during production. The casing 102 and production zone 104 may then be perforated in order to allow production fluids to enter the casing 102 and contact the tubular 106 and the cable 112. It should be appreciated that the casing 102 may be perforated before the tubular 106 is placed in the casing 102. The sand screen and/or flow control valve may be initially closed thereby preventing production fluids from entering the bore of the tubular 106.

The light source may then send a signal down at least one of the optical fibers 200 in the cable 112 in order to open the flow control valve 120 thereby allowing production fluids to flow past the sand screen and into the tubular 106. The production fluid may contain sand, particles, or other aggregate material. The sand and/or particles flow with the production fluid, thereby causing an abrasive effect on components the particles encounter. Due to the location of the abrasive resistant portions 114, only the elastomeric layer 204 or the partial elastomeric layer 300 of the cable 112 come in direct contact with the flowing sand and/or particles. The elastomeric layers 204 and 300 absorb the impact energy created when the sand or particles encounter the cable 112. Thus, the metal tubing 202 and/or the optical fiber will not be eroded by the sand and/or particles flowing with the production fluid. During the production of the production zones 104, the sensors in the cable 112 may be interrogated in order to monitor conditions in the wellbore 100.

In an alternative embodiment, the cable is used in conjunction with an open hole completion. The open hole completion does not require a sand screen. In a typical open hole completion the cable would be located in a production flow path but not necessarily proximate a production tubular. The cable 112 may be located in a gravel pack, not shown. The cable 112 may have any configuration described above.

While the foregoing is directed to embodiments of the present invention, other and further embodiments of the invention may be devised without departing from the basic scope thereof, and the scope thereof is determined by the claims that follow.

The invention claimed is:

1. A cable for use in a wellbore, comprising:

one or more optical fibers; and a layer of elastomeric material on at least a portion of an outer surface of the cable configured to resist an abrasive condition in the wellbore, wherein the layer of elastomeric material comprises a plurality of holes arranged such that the plurality of holes will face a tubular disposed in the wellbore when the cable is located adjacent the tubular and will not face the abrasive condition in the wellbore.

2. The cable of claim 1, wherein the elastomeric material is a polymeric material which at an ambient temperature stretches to at least twice its original length upon application of a predetermined force and returns to substantially its original length when the force is removed.

3. The cable of claim 1, further comprising one or more metal tubes between the one or more optical fibers and the layer of elastomeric material.

4. The cable of claim 3, wherein the at least the portion encompasses only a part of the circumference of the one or more metal tubes.

5. The cable of claim 4, wherein the part of the circumference is configured to protect the one or more metal tubes from the abrasive effects of debris flowing in a production fluid.

6. The cable of claim 1, wherein the at least the portion extends the entire length of the cable.

7. The cable of claim 1, wherein the cable is adapted to monitor a condition in the wellbore.

8. The cable of claim 7, where the condition is the temperature within the wellbore.

9. The cable of claim 7, wherein the condition is the pressure within the wellbore.

10. The cable of claim 1, further comprising a thermally conductive additive impregnated in the elastomeric material and adapted to transmit heat from an outer surface of the layer of elastomeric material to an inner surface of the layer of elastomeric material.

11. The cable of claim 10, wherein the thermally conductive additive comprises boron nitride.

12. The cable of claim 10, wherein the thermally conductive additive comprises at least one of alumina, magnesium oxide, zinc oxide, aluminum oxide, aluminum nitride, silver-coated organic particles, silver-plated nickel, silver-plated copper, silver-plated aluminum, silver-plated glass, silver flakes, carbon black, graphite, boron-nitride-coated particles, or carbon nano-tubes.

13. The cable of claim 1, wherein the layer of elastomeric material comprises non-thermoplastic elastomeric material.

14. The cable of claim 1, wherein the one or more optical fibers comprise one or more sensors.

15. The cable of claim 14, wherein the one or more sensors comprise a fiber Bragg grating.

16. The cable of claim 1, further comprising a protective layer surrounding the one or more optical fibers for at least a portion of the length of the cable, wherein the protective layer comprises a corrosion resistant material and is configured to protect the cable from impact loads.

17. The cable of claim 16, wherein the protective layer extends the entire length of the cable with the exception of one or more areas having the layer of elastomeric material.

18. The cable of claim 1, wherein the elastomeric material comprises at least one of polyisoprene, polybutadiene, acrylonitrile butadiene rubber, hydrogenated acrylonitrile butadiene rubber, chloroprene rubber, butyl rubber, polysulfide rubber, urethanes, styrene butadiene rubber, ethylene propylene rubber, ethylene propylene diene rubber, epichlorohydrin rubber, polyacrylic rubber, fluorosilicone rubber, fluoroelastomers, perfluoroelastomers, tetrafluoro ethylene/propylene rubbers, chlorosulfonated polyethylene, or ethylene-vinyl acetate.

* * * * *